US005148799A

United States Patent [19]

St-Louis et al.

[11] Patent Number: 5,148,799

[45] Date of Patent: Sep. 22, 1992

[54] INFRARED ASPHALT HEATER

[75] Inventors: Eric R. St-Louis, Dollard-Des-Ormeaux; Jonathan P. St-Louis; Kai G. St-Louis, both of Terrebonne, Quebec, all of Canada

[73] Assignee: Equipments St. Louis & Fils, Inc., Laval, Canada

[21] Appl. No.: 690,141

[22] Filed: Apr. 23, 1991

[51] Int. Cl.[5] ..... F23C 5/00

[52] U.S. Cl. ..... 126/271.2 A; 404/95

[58] Field of Search ..... 126/271.2 R, 271.2 A; 404/95

[56] References Cited

U.S. PATENT DOCUMENTS

| | | | |
|---|---|---|---|
| 3,801,212 | 4/1974 | Cutler | 126/271.2 A |
| 4,347,016 | 8/1982 | Sindelar et al. | 126/271.2 A |
| 4,555,200 | 11/1985 | Morrison | 404/95 |
| 4,601,605 | 7/1986 | Damp et al. | 126/271.2 A |
| 4,752,155 | 6/1988 | Rennich | 126/271.2 A |
| 4,869,235 | 9/1989 | Miles et al. | 126/271.2 R |

*Primary Examiner*—Carroll B. Dority

*Attorney, Agent, or Firm*—Cooper & Dunham

[57] ABSTRACT

An infrared asphalt cold seam heater vehicle is self-propelled and has sidewardly extending infrared heating chambers for heating existing asphalt to soften it for bonding with freshly laid asphalt to minimize premature failure. The heater has heating chambers attachable to either the right or left side of the vehicle.

15 Claims, 2 Drawing Sheets

INFRARED ASPHALT HEATER

BACKGROUND OF THE INVENTION

The present invention relates to an asphalt heating unit for heating existing asphalt pavement to a temperature sufficient to provide a bonding of newly laid asphalt and previously laid asphalt at speeds comparable to the speed of an asphalt paver, thereby permitting the fusing or bonding of new asphalt material from an asphalt paver with existing, previously laid asphalt pavement.

During asphalt paving operations, it is frequently necessary to apply a lift or mat of new hot asphalt adjacent to existing cold asphalt pavement which has been laid possibly a few days or a week beforehand. The joining line between the hot asphalt and cold asphalt is sometimes referred to as a seam or joint, and is viewed as an inherent weak point in the pavement subject to premature failure. Frequently, the existing asphalt has accumulated dirt and stone dust on its surface which, together with the difference in temperature of the hot and cold asphalt, prevents a proper bonding of the new and old asphalt at the seam. This joint or seam problem is a significant one confronting the asphalt paving industry, whether the asphalt paving application is for roads, parking lots, airport runways or taxiways, for example.

One approach to minimize this problem has been to stagger the seams of the various courses of asphalt. In typical asphalt paving, a binder course is first laid over a roadbed, and this binder course has a thickness on the order of several inches. If the asphalt paving machine is set to lay asphalt 10 feet in width, for a 20-foot roadway a seam will appear in the center of the roadway at the crown of the road. A second or wear course is applied on top of the binder course, but the middle seam of this wear course may be staggered relative to the seam of the binder course. However, even with the staggered seam method, the top seam still exists and provides an inherent weak point whereby the seam tends to enlarge and separate after one or two seasons of use. As soon as a separation in a seam occurs, it gradually increases in width due to the constant thawing and freezing of water during inclement weather and the hydraulic pumping action from constant traffic flow, which causes the asphalt to break out and leave large cracks and holes in the asphalt pavement.

While attempts have been made to heat the edge of the cold asphalt pavement or lift in preparation for laying a screed of hot asphalt adjacent to the previously laid asphalt, these attempts have met with limited success.

SUMMARY OF THE INVENTION

It is an object of the present invention to provide an asphalt heating unit which heats and conditions existing asphalt to a sufficient temperature to provide a bonding of newly laid and previously laid asphalt and at a sufficient rate of speed comparable to the speed of an asphalt paving machine.

In accordance with the present invention, an asphalt heating unit is provided comprising a self-propelled vehicle having a frame with a front, two sides and a rear end, and asphalt heating chamber means for generating heat to heat and soften asphalt pavement. A heater support means is attached to the frame for holding the heating chamber off to the side of the vehicle frame, wherein the heating chamber means generates sufficient heat to heat the asphalt to a temperature sufficient to provide a bonding of newly laid and previously laid asphalt while the vehicle is in motion.

The asphalt heating unit according to the present invention, by providing a means for effectively heating existing asphalt to a sufficient temperature to thereby provide a sufficient bonding of the new and old asphalt, effectively provides a seamless mat which combines the newly laid and previously laid asphalt, thereby eliminating or substantially reducing the seam between two adjacent mats of asphalt.

Other objects and advantages of the present invention will appear from the foregoing detailed description of the preferred embodiment, accompanying claims and attached drawings.

DETAILED DESCRIPTION OF THE PREFERRED EMBODIMENT

The preferred embodiment of an asphalt heating unit according to the present invention will now be described with reference to FIGS. 1 and 2. It should be understood that this preferred embodiment is merely exemplary of the present invention and is not intended to limit the scope of the invention to this preferred embodiment.

Figure 1:
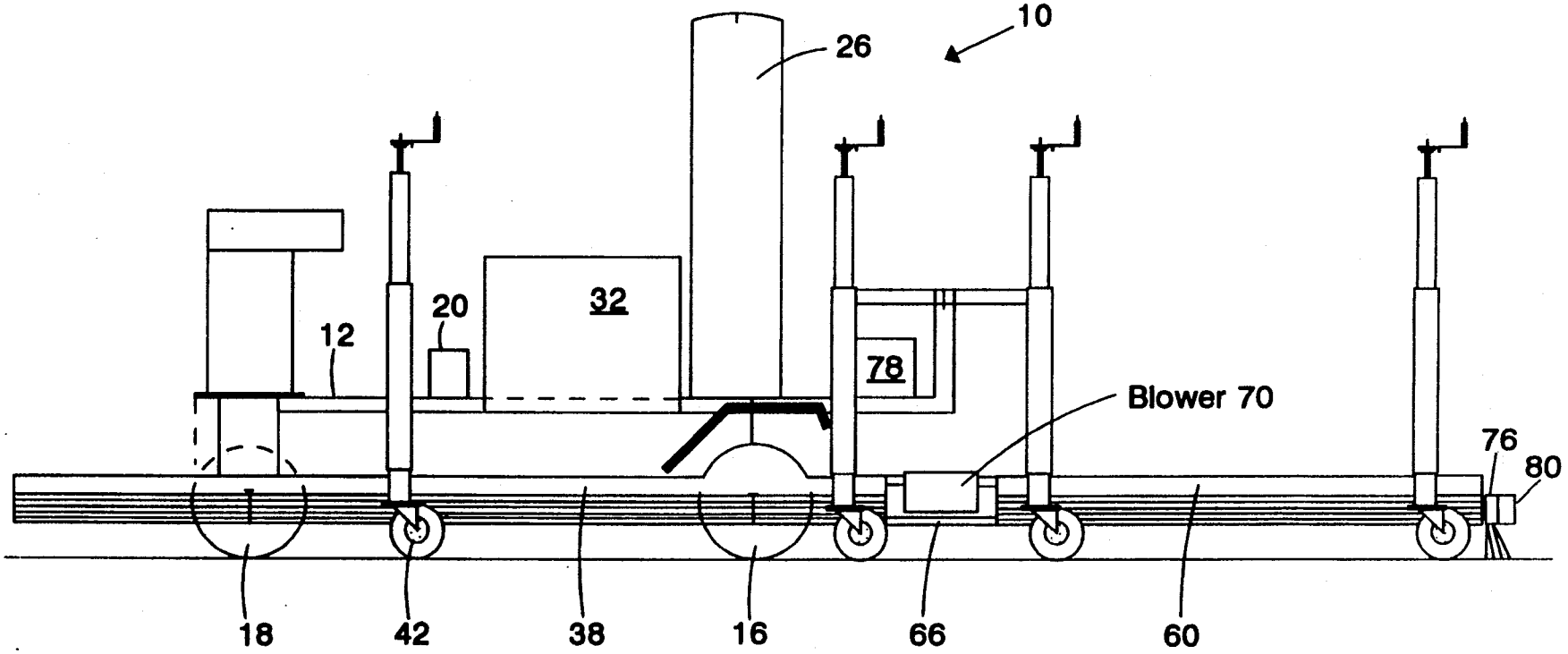
FIG. 1 is a side elevational view of an asphalt heating unit according to the present invention.

FIG. 1 shows a side elevational view of an asphalt heating unit 10 according to the present invention. The unit comprises a vehicle frame 12 with a front, two sides and a rear end. The frame is in the form of a vehicle trailer having two rear wheels 14, 16 and a removable front driving wheel 18. The front wheel 18 is motorized by means of a gasoline engine 20, which may be a one cylinder HONDA gas engine which hydraulically drives the vehicle frame. The hydraulic drive may comprise a pump driven by the engine and a flow control valve for controlling the flow of hydraulic oil to control the speed of the driving wheel 18. Located on the vehicle frame are two propane tanks 24, 26 and a control panel 28. Two hydraulic tanks 30, 32 are also provided for storing hydraulic oil.

Towards the front of the frame is a sidewardly extending heater support arm 34 which is connected to a first manual jack 36. The manual jack 36 is connected at its lower end to a first forward heating chamber 38. The manual jack 36 has two wheels 40, 42 which are positioned on opposite sides of the heating chamber 38. The wheels are independently height-adjustable, so that one wheel can ride on a binder course, while the other can ride on a previously laid wear course higher in elevation than the binder course. The adjustable wheels allow it to compensate for the elevation differences between the two mats. The heating chamber 38, as can be seen from FIG. 2, is positioned to one side of the vehicle frame less than one foot or so above the ground, but this distance can be adjusted by the manual jack.

Disposed at the rear end of the vehicle frame 12 is another heater support Y-bracket 50 which branches into two arms 52, 54. The forwardmost arm 52 is connected to another manual jack 56. This manual jack 56 is connected to the rear end of the first forward heating chamber 38. The other arm 54 of the Y-bracket is connected to a third manual jack 58. The third manual jack 58 is connected to support a second rear heating chamber 60 at its forward end. A fourth manual jack 62 supports the rear end of the rear heating chamber 60. The forward and rear heating chambers are connected to each other directly by means of two frame members 64, 66. The manual jacks provide a means for adjusting the height of the heating chambers to compensate for the elevation difference between the two mats. The manual jacks 56, 58 and 62 each have two adjustable wheels like those of jack 36.

Figure 2:
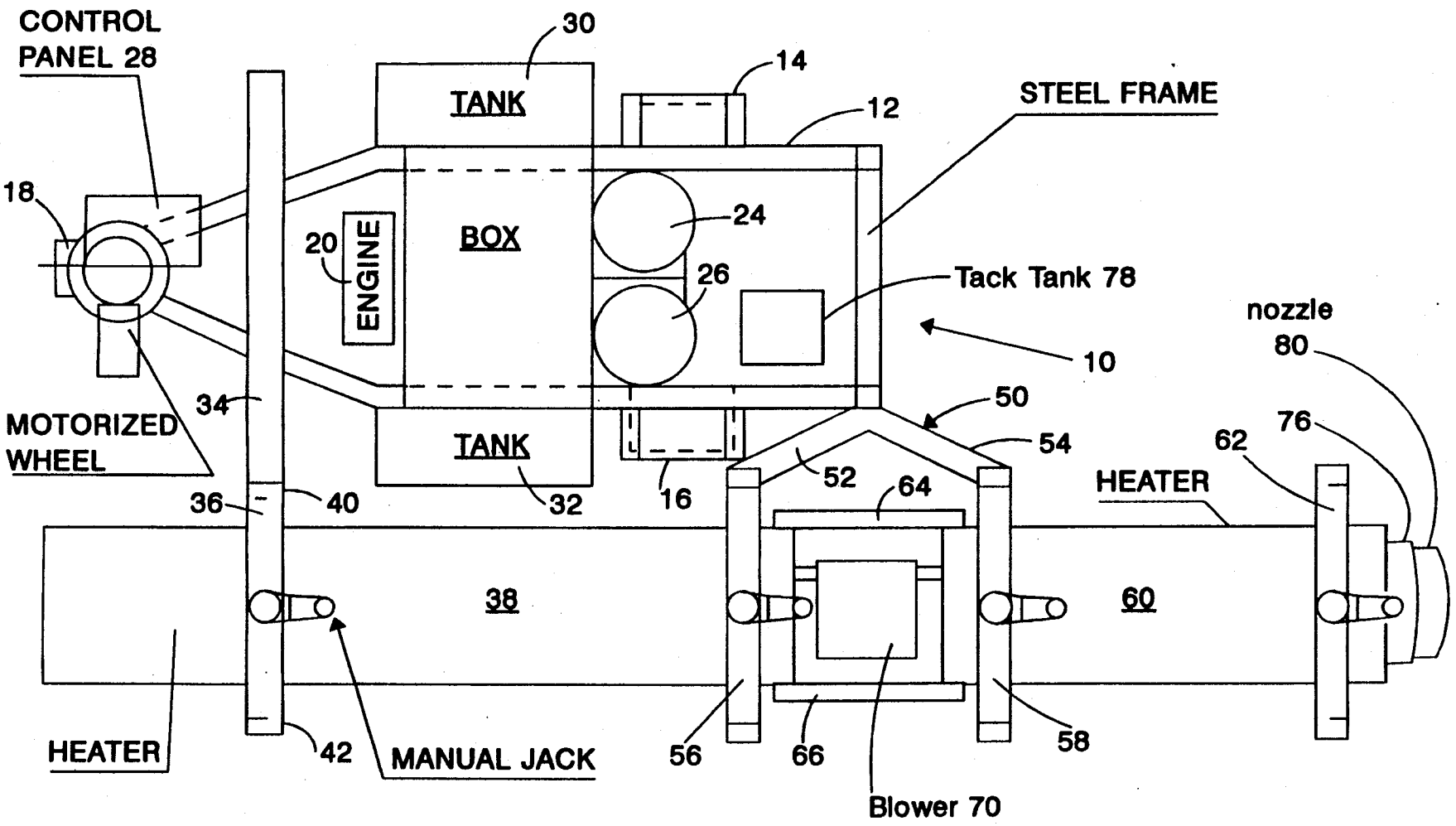
FIG. 2 is top plan view of the asphalt heating unit of FIG. 1.

The rear heater support Y-bracket 50 can be moved from the position shown in FIG. 2, where it extends from the rear left side of the vehicle frame, to a corresponding position on the rear right side of the frame. The first manual jack 36 can likewise be attached to the other side of the heater support arm 34 to extend from the left side of the vehicle frame. In this alternative arrangement, the heating chambers will be positioned off to the right flank of the vehicle frame instead of to the left flank as shown in FIG. 2. The heating chambers can thus be positioned at the most convenient location for productivity of the crews for a particular paving jobsite, and safety of the crew and traffic, especially where the jobsite is on a used roadway.

The asphalt heating chambers each have at least one infrared heater. Preferably, the heaters comprise "Inconel" infrared heating elements. The heating chambers include a blower 70 for mixing air and propane gas and supplying the mixture to the infrared heaters. The electric blower has a motor which may be powered by deep-cell batteries or continually by the gasoline engine 20.

The gasoline engine and hydraulic drive have sufficient power to drive the vehicle frame at speeds up to about 150 feet per minute. The theoretical maximum speed of existing asphalt paving equipment is about 100–150 feet/minute. In practical application, the paving speed is rarely above 80 feet/minute. Of course the speed of asphalt paving equipment is dependent upon the width of the screed (e.g. 8, 10 or 15 feet) and other variables. The hydraulic drive arrangement enables the operator to adjust the speed of the vehicle to virtually any speed between 0 and the maximum speed. The asphalt heating unit can thus heat the existing cold asphalt ahead of the paving unit, thereby permitting the asphalt paver to screed asphalt at the speed desired without costly delay. The asphalt heating unit has a relatively small compact size, and thus does not interfere with oncoming traffic in adjacent lanes, thereby keeping traffic flowing if the need arises.

The heating chamber mounting mechanisms and jacks can be easily removed from the trailer and loaded into another towing vehicle which can tow the trailer from jobsite to jobsite. The front driving wheel is also removable.

In an exemplary embodiment, the wheel base of the driven wheel and rear wheels of the vehicle trailer is on the order of 6 feet, and each heating chamber is about 15 inches wide by about 11 feet long. The outside edge of the heating chamber extends about 45 inches from the center line of the vehicle trailer. By keeping the vehicle frame relatively short in length and narrow in width the vehicle can be easily handled, which is important in the paving industry. The heating chambers are also easy to handle and transport, and provide a practical and relatively inexpensive arrangement for the paving industry, where competition is keen, and cost control, ease of use and size of the crew are factors.

A scarifier 76 is attached to the rear end of the second rear heating chamber 60 to scarify the asphalt surface and remove whatever dirt and stone dust which has accumulated on that surface to expose uncontaminated asphalt and thereby provide a more bondable surface. The scarifier may comprise, for example, a steel brush or steel teeth. The unit also includes a tack coat tank 78 which can simultaneously apply a tack coat under pressure to the seam at nozzle 80 if such tack coat is desired or required in view of specifications for a particular job.

The asphalt heating unit according to the present invention can heat existing asphalt to a temperature sufficient to provide a bonding of newly laid and previously laid asphalt at speeds comparable to the asphalt paver speed, thereby permitting the fusing or bonding of the material being placed in the adjacent lane with material already in place, to effectively provide a seamless mat. Although many variables are involved in determining the precise temperature to which the existing asphalt should be heated, a temperature of about 275° F. has been found to be satisfactory. However, the invention is not limited to this temperature. If additional heating capacity is needed, additional heating chambers can be added.

While the preferred embodiment has been described with reference to heating an existing mat of asphalt in preparation for laying a new mat of asphalt adjacent thereto, the invention may also be used for repairing defective seams or holes.

Although a preferred embodiment according to the present invention has been described in detail above, the invention is not limited to this embodiment, as numerous variations and modifications will occur to those of ordinary skill in the art. The present invention is thus not limited to the specific embodiment illustrated but is limited only by way of the appended claims.

We claim:

1. An asphalt heating unit, comprising:

a self-propelled vehicle frame with vehicle wheels, a front, two sides and a rear end;

asphalt heating chamber means for generating heat to heat and soften asphalt pavement;

heater support means removably attached to said vehicle frame for holding the heating chamber means off to the side of the vehicle frame, whereby the heating chamber means are located entirely and only at a vehicle flank out of the path of the vehicle wheels;

adjustable support mechanism attached to said heating chamber said support mechanism having wheels on opposite sides of said heating chamber for engagement with a roadway and means for adjusting the height of the heating chamber from the roadway;

wherein said heating chamber means generates sufficient heat to heat the asphalt to a temperature sufficient to provide a bonding of newly laid and previously laid asphalt at a junction line at the vehicle flank while the vehicle is in motion.

2. The asphalt heating unit according to claim 1, wherein the heater support means comprises a first arm extending outwardly from the side at the frame, and a second arm extending outwardly from the side of the frame and spaced form said first arm.

3. The asphalt heating unit according to claim 1, wherein the adjustable support mechanism comprises two separate adjustable support mechanisms connected to said heating chamber.

4. The asphalt heating unit according to claim 1, wherein the asphalt heating chamber means comprises two heating chambers.

5. The asphalt heating unit according to claim 1, wherein the asphalt heating chamber means comprises an infrared heater.

6. The asphalt heating unit according to claim 4, further comprising a blower for mixing air and gas and for supplying said mixture to said infrared heater.

7. The asphalt heating unit according to claim 5, wherein the asphalt heating chamber means comprises two heating chambers and wherein the blower provides an air and gas mixture to both of the two heating chambers.

8. The asphalt heating unit according to claim 5, wherein the blower comprises an electric blower motor powered by rechargeable batteries.

9. The asphalt heating unit according to claim 1, wherein the self-propelled vehicle frame comprises two side wheels and a front driven wheel.

10. The asphalt heating unit according to claim 7, wherein the self-propelled vehicle frame comprises a gasoline engine and driving pump for hydraulically driving said vehicle frame.

11. The asphalt heating unit according to claim 1, further comprising a scarifying means for scarifying the asphalt surface.

12. The asphalt heating unit according to claim 1, further comprising a tack coat tank and means for applying said tack coat to an asphalt seam.

13. The asphalt heating unit according to claim 1, wherein the heater support means is removably attached to said frame.

14. The asphalt heating unit according to claim 1, the frame has means for removably receiving the heater support means on either side of the frame, whereby the heating chamber can extend from either side of the vehicle frame.

15. An asphalt heating unit, comprising:

a self-propelled vehicle frame with a front, two sides and a rear end;

asphalt heating chamber means for generating heat to heat and soften asphalt pavement;

wheel means for supporting opposite sides of the chamber means above the ground;

heater support means attached to said frame for holding the heating chamber to the side of the vehicle frame;

means for adjusting the height of the heating chamber means from the ground;

wherein said heating chamber means generates sufficient heat to heat the asphalt to a temperature sufficient to provide a bonding of newly laid and previously laid asphalt while the vehicle is in motion.

* * * * *